US008803016B2

(12) United States Patent
Kang

(10) Patent No.: US 8,803,016 B2
(45) Date of Patent: Aug. 12, 2014

(54) DOME SHEET STRUCTURE INCLUDING LIGHT GUIDE FILM AND MOBILE COMMUNICATION TERMINAL INCLUDING THE DOME SHEET STRUCTURE

(75) Inventor: Choon Kwon Kang, Seoul (KR)

(73) Assignee: Pantech Co., Ltd., Seoul (KR)

( * ) Notice: Subject to any disclaimer, the term of this patent is extended or adjusted under 35 U.S.C. 154(b) by 749 days.

(21) Appl. No.: 12/831,686

(22) Filed: Jul. 7, 2010

(65) Prior Publication Data

US 2011/0079499 A1 Apr. 7, 2011

(30) Foreign Application Priority Data

Oct. 6, 2009 (KR) ..... 10-2009-0094615

(51) Int. Cl.
*H01H 1/10* (2006.01)

(52) U.S. Cl.
USPC ..... 200/512; 200/516; 200/406; 200/314

(58) Field of Classification Search
CPC . G02B 6/006; H01H 13/83; H01H 2219/062; H01H 2209/082; H01H 2209/002; H01H 2221/07; H01H 2205/026; H01H 13/78; H01H 13/85
USPC ..... 200/512
See application file for complete search history.

(56) References Cited

U.S. PATENT DOCUMENTS

| | | | | |
|---|---|---|---|---|
| 7,718,909 | B2 * | 5/2010 | Masuda | 200/310 |
| 2009/0095607 | A1 * | 4/2009 | Tatehata et al. | 200/314 |

FOREIGN PATENT DOCUMENTS

| | | | |
|---|---|---|---|
| JP | 2003-217391 | | 7/2003 |
| JP | 2003217391 | * | 7/2003 |
| KR | 10-0753324 | | 8/2007 |

* cited by examiner

*Primary Examiner* — R S Luebke
*Assistant Examiner* — Lheiren Mae Caroc
(74) *Attorney, Agent, or Firm* — H.C. Park & Associates, PLC

(57) ABSTRACT

A dome sheet structure of a mobile communication terminal may include: a metal dome covering a contact point printed on a printed circuit board; and a light guide film disposed on the metal dome. The light guide film may be bonded with the metal dome in a bonding area, and the bonding area may be an area between two concentric circles having different diameters and centered at a center of the metal dome.

15 Claims, 6 Drawing Sheets

DOME SHEET STRUCTURE INCLUDING LIGHT GUIDE FILM AND MOBILE COMMUNICATION TERMINAL INCLUDING THE DOME SHEET STRUCTURE

CROSS-REFERENCE TO RELATED APPLICATION

This application claims priority from and the benefit of Korean Patent Application No. 10-2009-0094615, filed on Oct. 6, 2009, which is hereby incorporated by reference for all purposes as if fully set forth herein.

BACKGROUND

1. Field

Exemplary embodiments of the present invention relate to a dome sheet structure including a light guide film and a mobile communication terminal having the dome sheet structure.

2. Discussion of the Background

A mobile communication terminal includes a keypad module that is an input unit through which information is input. The keypad module may be relatively thin and enables various information signals to be generated and input. Accordingly, the keypad module is applied to various types of electronic devices as well as the mobile communication terminal.

Mobile phones currently on the market are becoming slimmer and have multiple functions. A light emitting diode (LED) sheet and an electroluminescence (EL) sheet have been generally used for a light emitting device for a keypad so that a user may recognize input keys of a mobile phone even in a dark environment. Currently, a scheme of configuring a light emitting device using a light guide sheet or a light guide film is being developed and used.

FIG. 1 is a cross-sectional view illustrating a conventional dome sheet structure having a light guide film 15. In the dome sheet structure of FIG. 1, a base film 12 is disposed on a printed circuit board 10, a metal dome 13 is disposed at a location on the printed circuit board 10, and a top film 14 is disposed on the base film 12 and the metal dome 13.

The light guide film 15 is disposed on the top film 14 to enhance and regulate a light emitting characteristic of a keypad. The light guide film 15 may be attached to the top film 14 using an adhesive or a double-sided tape.

However, since the conventional dome sheet structure is constructed by additionally applying the light guide film 15 to a general dome sheet structure, the conventional dome sheet structure may be thick. Manufacturing costs may also rise and a user may have a decreased click feeling.

SUMMARY

Exemplary embodiments of the present invention provide a dome sheet structure is including a light guide film bonded with a metal dome in a bonding area, and a mobile communication terminal having the dome sheet structure.

Additional features of the invention will be set forth in the description which follows, and in part will be apparent from the description, or may be learned by practice of the invention.

An exemplary embodiment of the present invention discloses a dome sheet structure, including a metal dome covering a contact point printed on a printed circuit board; and a light guide film disposed on the metal dome, wherein the light guide film is bonded with the metal dome in a bonding area, the bonding area being an area between two concentric circles having different diameters and centered at a center of the metal dome.

An exemplary embodiment of the present invention discloses a keypad module including a printed circuit board including a contact point; a base film disposed on a surface of the printed circuit board to cover a portion of the printed circuit board excluding the contact point, a metal dome disposed to cover the contact point; a light guide film disposed on the metal dome and the base film; and a keypad disposed on the light guide film.

An exemplary embodiment of the present invention discloses a mobile communication terminal including a keypad module including a metal dome covering a contact point printed on a printed circuit board, a base film disposed on a surface of the printed circuit board to cover a portion of the printed circuit board excluding the contact point, a light guide film disposed on the metal dome, and a keypad disposed on the light guide film, the keypad comprising a key, and a case covering the keypad module, the case comprising a hole corresponding to the key of the keypad so that the key is externally exposed.

An exemplary embodiment of the present invention discloses a method for manufacturing a metal dome structure, the method including bonding a metal dome, the metal dome covering a contact point printed on a printed circuit board, with a light guide film disposed on the metal dome, wherein the light guide film is bonded with the metal dome in a bonding area, the bonding area being an area between two concentric circles having different diameters and centered at a center of the metal dome.

An exemplary embodiment of the present invention discloses a method for manufacturing a keypad module, including providing a printed circuit board including a contact point, disposing a base film on a surface of the printed circuit board to cover a portion of the printed circuit board excluding the contact point, disposing a metal dome to cover the contact point, bonding the light guide film with the metal dome in a bonding area, the bonding area being an area between two concentric circles having different diameters and centered at a center of the metal dome; and disposing a keypad on the light guide film.

It is to be understood that both the foregoing general description and the following detailed description are exemplary and explanatory and are intended to provide further explanation of the invention as claimed

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
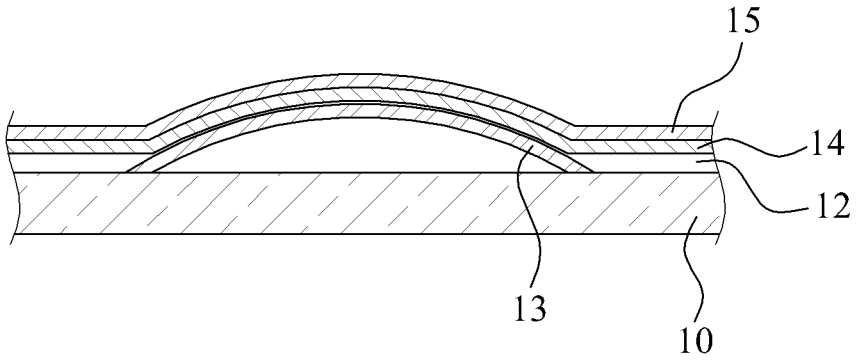
FIG. 1 Related Art
FIG. 1 is a cross-sectional view illustrating a conventional dome sheet structure having a light guide film.

Aspects of the invention are described more fully hereinafter with reference to the accompanying drawings, in which exemplary embodiments of the invention are shown. This disclosure may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element is referred to as being "connected to" or "disposed on" another element, it can be directly connected to or directly disposed on the other element, or intervening elements may be present.

Figure 2:
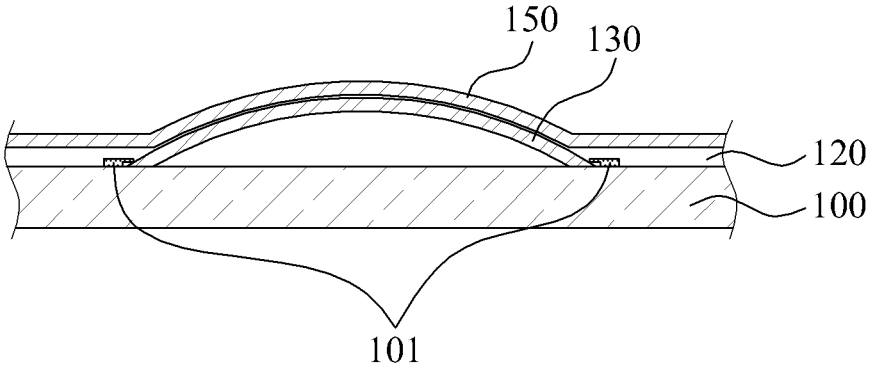
FIG. 2 is a cross-sectional view illustrating a dome sheet structure according to an exemplary embodiment of the present invention.

FIG. 2 is a cross-sectional view illustrating a dome sheet structure according to an exemplary embodiment of the present invention. As shown in FIG. 2, the dome sheet structure is includes a metal dome 130 and a light guide film 150.

The metal dome 130 is disposed to cover, respectively, each of contact points printed on a printed circuit board 100 to generate an electrical signal. A guide member 101 may be formed on the printed circuit board 100, or may be provided as a separate member. The guide member 101 may guide the metal dome 130 to be disposed at a location corresponding to the contact point. Specifically, the metal dome 130 may be disposed in a dome shape at a distance separated from the printed circuit board 100, i.e., having a height above the printed circuit board 100.

The light guide film 150 may be disposed to emit light entering from a light source (not shown) from a surface of the light guide film 150. The light guide film 150 may be formed of a material having an excellent conductivity. For example, the light guide film 150 may include polycarbonate (PC) and/or polyethylene terephthalate (PET).

The light guide film 150 may be bonded with the metal dome 130 in a bonding area. The light guide film 150 may be bonded to the metal dome 130 in the bonding area by an adhesive or a double-sided tape. The bonding area corresponds to an area between two concentric circles having different diameters and centered at a center of the metal dome 130, and may be provided in a form of an annulus, i.e., a donut shape. The bonding area may further correspond to an area between the metal dome 130 and the light guide film 150 or an upper surface of the metal dome 130. The bonding area will be further described with reference to FIG. 6.

The dome sheet structure may further include a base film 120 disposed on the printed circuit board 100. The base film 120 may upwardly reflect the light of the light guide film 150. A hole (not shown) may be formed in the base film 120 corresponding to a position at is which the metal dome 130 is disposed, particularly, in correspondence to a contact point printed on the printed circuit board 100. Accordingly, the base film 120 may be disposed on a surface of the printed circuit board 100 to cover a remaining portion excluding the contact point. In this instance, due to a deformation of the metal dome 130, the base film 120 may contact the contact point of the printed circuit board 100 to thereby generate an electrical signal. The base film 120 with the formed hole may replace the guide member 101 guiding the metal dome 130 to be disposed at the location corresponding to the contact point. In this case, the guide member 101 may be omitted.

Figure 3:
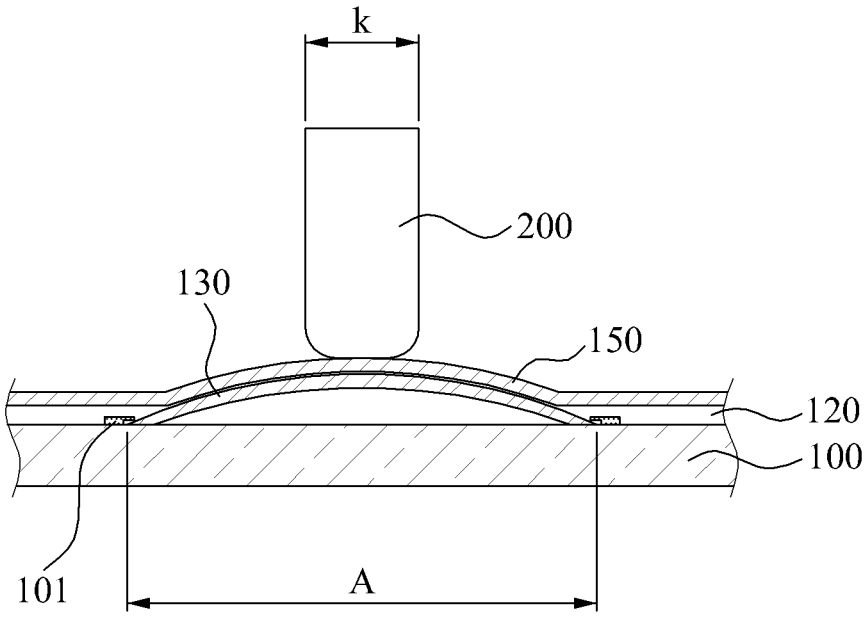
FIG. 3 is a cross-sectional view illustrating a keypad module according to an exemplary embodiment of the present invention.

FIG. 3 is a cross-sectional view illustrating a keypad module according to an exemplary embodiment of the present invention. As shown in FIG. 3, the keypad module includes a printed circuit board 100, a base film 120, a metal dome 130, a light guide film 150, and a keypad (not shown). Descriptions related to like elements described above with reference to FIG. 2 will be omitted here.

Contact points may be printed on the printed circuit board 100 to generate an electrical signal in order to perform a function of a mobile communication terminal. Circuits and various products may be disposed on or connected to the printed circuit board 100. The base film 120 may be disposed on a top surface of the printed circuit board 100, and the base film 120 may be attached to the printed circuit board 100.

The base film 120 may upwardly reflect the light of the light guide film 150. A hole (not shown) may be formed in the base film 120 corresponding to a position at which the metal dome 130 is disposed, particularly, in correspondence or alignment to the contact point printed on the printed circuit board 100. Accordingly, the base film 120 may be disposed on a surface of the printed circuit board 100 to cover a remaining portion excluding the contact point. In this instance, due to a deformation of the metal dome 130 corresponding to the hole, the base film 120 may contact the contact point of the printed circuit board 100 to thereby generate an electrical signal.

The light guide film 150 may be disposed on the metal dome 130 and the base film 120. The light guide film 150 may secure the metal dome 130 at a location of the printed circuit board 100, that is, in a location corresponding to the contact point.

In this instance, a pressurizing member 200 selectively pressurizing the metal dome 130 may be provided. Due to a pressure caused by the pressurizing member 200, the metal dome 130 may contact with the contact point and generate an electrical signal. The pressurizing member 200 may be provided as a general actuator pressurizing the metal dome 130 included in the mobile communication terminal. However, aspects of the present invention are not limited thereto, and thus, various examples may be applicable.

Generally, a plurality of buttons may be provided on a button unit (not shown). If a user pushes a button, the pressurizing member 200 functions to selectively pressurize the metal dome 130.

In the case of a general key operation of the mobile communication terminal, for example, if a button is pushed, the metal dome 130 may be transformed to contact with the contact point of the printed circuit board 100. For this, a diameter k of the pressurizing member 200 may be calculated according to the following Equation 1:

$$k=(0.35\pm\alpha)\times A, \qquad \text{[Equation 1]}$$

in which $\alpha$ represents a constant to determine the diameter k of the pressurizing member 200 and is determined within 0.05, and A represents a diameter of the metal dome 130.

The metal dome 130 may have a 4 mm or 5 mm diameter. According to Equation 1, the diameter k of the pressurizing member 200 may be determined to be about $35\pm\alpha$% of the diameter A of the metal dome 130. Specifically, the diameter k of the pressurizing member 200 may be included within 30% to 40% of the diameter A of the metal dome 130.

An area of the metal dome 130 may be formed to be six times to ten times a contact area between the pressurizing member 200 and the metal dome 130 may be, for example, circular in shape.

Figure 6:
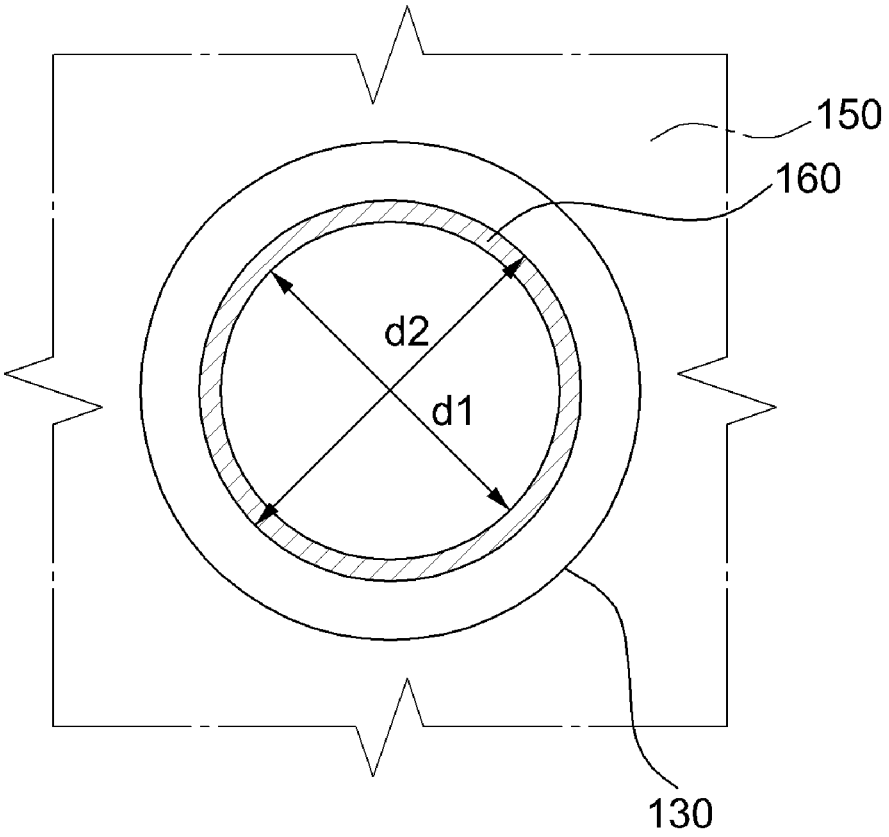
FIG. 6 is a top view illustrating a bonding area of a light guide film and a metal dome according to an exemplary embodiment of the present invention.

The light guide film 150 may be bonded with the metal dome 130. A bonding area 160, as shown in FIG. 6, corresponds to an area between two concentric circles having different diameters and centered at a center of the metal dome 130. The bonding area 160 may be provided in a form of an annulus, i.e., a donut shape. The bonding area may further correspond to an area between the metal dome 130 and the light guide film 150 or an upper surface of the metal dome 130.

Figure 4:
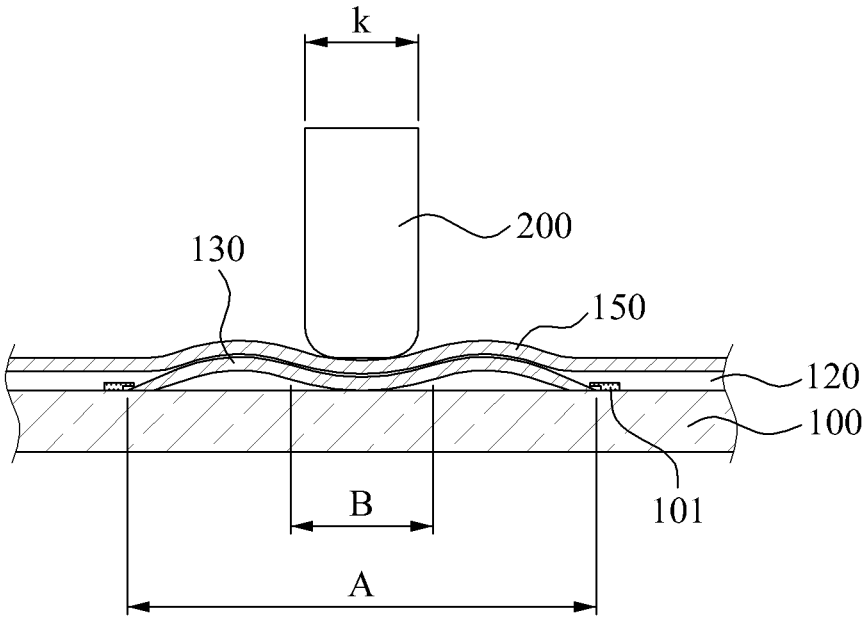
FIG. 4 is a cross-sectional view illustrating an operation of a metal dome pressurized by a pressurizing member of the keypad module of FIG. 3.
Figure 5:
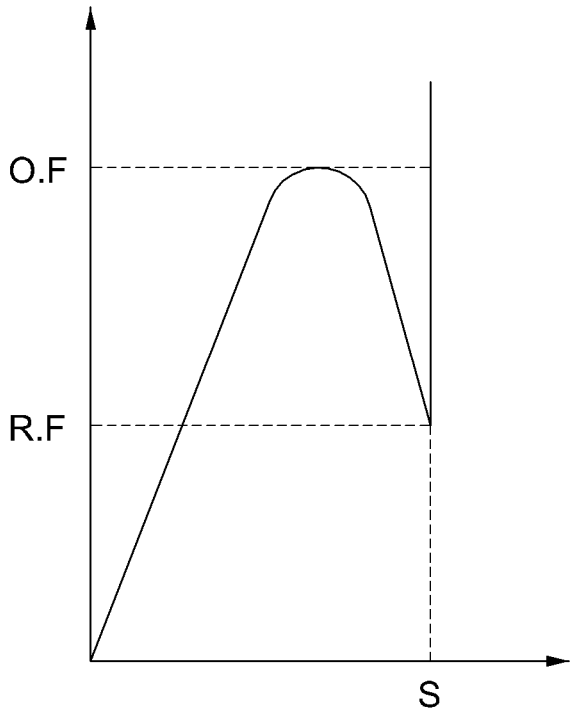
FIG. 5 is a graph of a click rate calculation equation according to FIG. 4.

The bonding area 160 of the metal dome 130 and the light guide film 150 may need to be defined to determine a click rate according to an operation of the metal dome 130 and the pressurizing member 200. It will be further described with reference to FIG. 4, FIG. 5 and FIG. 6. FIG. 4 is a cross-sectional view illustrating an operation of the metal dome 130 pressurized by the pressurizing member 200 of the keypad module of FIG. 3; FIG. 5 is a graph of a click rate calculation equation according to FIG. 4; and FIG. 6 is a top view illustrating the bonding area 160 of the light guide film 150 and the metal dome 130 according to an exemplary embodiment of the present invention.

As shown in FIG. 4, if the metal dome 130 operates due to the pressurizing member 200, a diameter of the metal dome 130 contacting with the printed circuit board 100 is may be calculated according to the following Equation 2:

$$B=k+\beta, \quad \text{[Equation 2]}$$

in which B represents the diameter of the metal dome 130 in contact with the printed circuit board 100, and β represents an assembly tolerance used to connect the metal dome 130 to the printed circuit board 100.

If the metal dome 130 and the light guide film 150 are entirely bonded with each other with respect to an area B, the metal dome 130 may lose an original operation force and an original return force whereby a click rate may significantly decrease. Here, the operation force represents a minimum force to operate a switch to make a contact, and the return force represents a maximum force to make a return using a self-return force or a self-restoring force, that is, to open the switch in the contact state.

Referring to FIG. 5, a relationship between the operation force and the return force with respect to the click rate may be expressed by the following Equation 3:

$$\text{Click Rate } (\%) = \frac{(OF - RF)}{OF} \times 100, \quad \text{[Equation 3]}$$

in which OF represents the operation force and RF represents the return force.

As shown in FIG. 5, to maintain the click rate, the return force to return the metal dome 130 to an original shape S may be relatively small compared to the operation force. To secure the click rate by maintaining the original operation force and return force of the metal dome 130, that is, to maintain an original click rate of the metal dome 130, the bonding area 160 may be limited. A relationship with respect to the bonding area 160 may be expressed by the following Equation 4 and Equation 5:

$$d1=B+\delta \quad \text{[Equation 4]}$$

$$d2=d1+(\text{bondable minimum width})\times 2. \quad \text{[Equation 5]}$$

As shown in FIG. 6, the bonding area 160 may be defined by two concentric circles having different diameters. Here, d1 represents a diameter of a relatively small circle between the two concentric circles, d2 represents a diameter of a relatively large circle between the two concentric circles, and δ represents a bonding tolerance.

Specifically, d1 is a sum of the diameter k of the pressurizing member 200, the assembly tolerance β, and the bonding tolerance δ. In Equation 4, B=k+β as per Equation 2. d2 is a sum of d1 and twice of a bondable minimum width.

To embody the keypad module or the dome sheet structure having the metal dome 130 according to aspects of the invention, a conventional top film (see the top film 14 of FIG. 1) may be removed and the metal dome 130 may be directly bonded with the light guide film 150. In addition, to maintain a click feeling equal to or better than a conventional dome sheet structure or keypad module, the bonding area 160 may be defined using the above Equation 4 and Equation 5 and a bonding process may be performed according to the bonding area 160.

Hereinafter, a bonding method of the keypad module constructed as above, that is, a method of manufacturing the keypad module will be described. Initially, a printed circuit board including contact points that generate an electrical signal may be provided and a base film may be provided on a surface of the printed circuit board to cover a portion of the printed circuit board excluding the contact points.

Metal domes may be disposed to correspond to or align with the contact points, respectively. Each of the metal domes and the light guide film may be bonded with each other in a corresponding bonding area. The bonding area corresponds to an area between two concentric circles having different diameters and centered at a center of a corresponding metal dome, and may be provided in a form of an annulus, i.e., a donut shape. The bonding area may further correspond to an area between the metal dome 130 and the light guide film 150 or an upper surface of the metal dome 130. A keypad may be provided above the light guide film to complete the manufacturing process of the keypad module.

According to an exemplary embodiment of the present invention, a mobile communication terminal may include a keypad module including a plurality of metal domes respectively covering contact points printed on a printed circuit board to generate an electrical signal, a base film disposed on a surface of the printed circuit board to cover a remaining portion excluding the contact points, a light guide film disposed on the plurality of metal domes, a keypad being disposed above the light guide film, and a case covering the keypad module and including holes corresponding to keys formed on the keypad so that the keys may be externally exposed or are protruded.

The case may be formed of a general material and shape used for an external case of the mobile communication terminal.

Here, each of the metal domes and the light guide film may be bonded with each other in a corresponding bonding area and each may be provided in a form of an annulus, i.e., a donut shape, which is similar to the dome sheet structure or the keypad module described above with reference to FIGS. 2 through 6. The bonding area may further correspond to an area between the metal dome 130 and the light guide film 150 or an upper surface of the metal dome 130.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A dome sheet structure, comprising:

a metal dome covering a contact point disposed on a printed circuit board; and a base film disposed on a surface of the printed circuit board to cover a portion of the printed circuit board excluding the contact point;

a light guide film disposed directly on the metal dome and the base film, wherein the light guide film is bonded with the metal dome in a bonding area, the bonding area being an area between two concentric circles having different diameters and centered at a center of the metal dome.

2. The dome sheet structure of claim 1, wherein the metal dome deforms to contact the contact point to generate an electrical signal.

3. The dome sheet structure of claim 2, wherein the metal dome deforms in response to an operation force, and returns to an original shape in response to a return force to open the contact between the metal dome and the contact point.

4. A keypad module, comprising:

a printed circuit board comprising a contact point;

a base film disposed on a surface of the printed circuit board to cover a portion of the printed circuit board excluding the contact point;

a metal dome disposed to cover the contact point;

a light guide film disposed directly on the metal dome and the base film; and a keypad disposed on the light guide film.

5. The keypad module of claim 4, wherein the light guide film is bonded with the metal dome in a bonding area, the bonding area being an area between two concentric circles having different diameters and centered at a center of the metal dome.

6. The keypad module of claim 5, further comprising: a pressurizing member disposed between the keypad and the light guide film to pressurize the metal dome to contact the printed circuit board, wherein an area of the metal dome is six times to ten times a contact area between the pressurizing member and the metal dome.

7. The keypad module of claim 6, wherein a diameter of a relatively small circle of the two concentric circles is a sum of a diameter of the pressurizing member, an assembly tolerance, and a bonding tolerance.

8. The keypad module of claim 7, wherein a diameter of a relatively large circle of the concentric circles is a sum of the diameter of the relatively small circle and twice of a bondable minimum width.

9. The keypad module of claim 6, wherein the metal dome contacts the printed circuit board to generate an electrical signal in response to an operation force from the pressurizing member, and the metal dome returns to an original shape in response to a return force to open the contact between the metal dome and the contact point.

10. A mobile communication terminal, comprising:

a keypad module, comprising:

a metal dome covering a contact point printed on a printed circuit board, a base film disposed on a surface of the printed circuit board to cover a portion of the printed circuit board excluding the contact point, a light guide film disposed directly on the metal dome and the base film, and a keypad disposed on the light guide film, the keypad comprising a key; and a case covering the keypad module, the case comprising a hole corresponding to the key of the keypad.

11. The mobile communication terminal of claim 10, wherein the light guide film is bonded with the metal dome in a bonding area, the bonding area being an area between two concentric circles having different diameters and centered at a center of a corresponding metal dome.

12. The mobile communication terminal of claim 10, wherein the metal dome deforms to contact the contact point to generate an electrical signal.

13. The mobile communication terminal of claim 12, wherein the metal dome deforms in response to an operation force from the key, and returns to an original shape in response to a return force to open the contact between the metal dome and the contact point.

14. A method for manufacturing a metal dome structure, the method comprising:

disposing a base film on a surface of a printed circuit board to cover a portion of the printed circuit board excluding a contact point; and bonding a metal dome, the metal dome covering the contact point printed on the printed circuit board, with a light guide film disposed directly on the metal dome and the base film, wherein the light guide film is bonded with the metal dome in a bonding area, the bonding area being an area between two concentric circles having different diameters and centered at a center of the metal dome.

15. A method for manufacturing a keypad module, the method comprising:

providing a printed circuit board comprising a contact point;

disposing a base film on a surface of the printed circuit board to cover a portion of the printed circuit board excluding the contact point;

disposing a metal dome to cover the contact point;

bonding a light guide film directly with the base film and the metal dome in a bonding area, the bonding area being an area between two concentric circles having different diameters and centered at a center of the metal dome; and disposing a keypad on the light guide film.

* * * * *